US011712400B2

(12) United States Patent
Kemp

(10) Patent No.: US 11,712,400 B2
(45) Date of Patent: Aug. 1, 2023

(54) ELASTICALLY WOVEN FACE CRADLE

(71) Applicant: Jacob Kemp, Santa Barbara, CA (US)

(72) Inventor: Jacob Kemp, Santa Barbara, CA (US)

( * ) Notice: Subject to any disclaimer, the term of this patent is extended or adjusted under 35 U.S.C. 154(b) by 525 days.

(21) Appl. No.: 16/831,425

(22) Filed: Mar. 26, 2020

(65) Prior Publication Data

US 2020/0306136 A1 Oct. 1, 2020

Related U.S. Application Data

(60) Provisional application No. 62/823,789, filed on Mar. 26, 2019.

(51) Int. Cl.
*A61G 13/12* (2006.01)
*A61H 37/00* (2006.01)

(52) U.S. Cl.
CPC ..... *A61H 37/00* (2013.01); *A61G 13/121* (2013.01); *A61H 2201/1607* (2013.01); *A61H 2203/0468* (2013.01); *A61H 2205/022* (2013.01)

(58) Field of Classification Search
CPC ..... A61G 13/12; A61G 7/072; A61H 37/00; A61H 2205/022; A47C 20/026; A47G 9/1054; A47G 9/1009
See application file for complete search history.

(56) References Cited

U.S. PATENT DOCUMENTS 2,398,940 A * 4/1946 Jones ..... A61G 13/12 5/622
2,551,727 A * 5/1951 Costello ..... A61G 7/072 5/643
2,581,802 A * 1/1952 Lyons ..... A47G 9/1009 5/643
2,634,435 A * 4/1953 Leighton ..... A47G 9/1054 5/643
3,114,527 A * 12/1963 Demarest ..... A47C 20/026 5/643
3,403,413 A * 10/1968 Calhoun ..... A47G 9/1009 5/643
4,823,776 A * 4/1989 Foster ..... A61G 13/12 5/643

(Continued)

OTHER PUBLICATIONS

The Forty Elastics Material Used to Create Elastic Fun Chair, Retrieved from Internet, Retrieved on Nov. 19, 2015 <URL: www.decorfeed.com>.

(Continued)

*Primary Examiner* — Eric J Kurilla

(57) ABSTRACT

An objective of the present invention is to provide users a face cradle that form-fits to the unique contours of a user's face, as the user suspends their face within the elastic woven components of the face cradle. Accordingly, the present invention provides an apparatus comprising of a structure that holds a webbed elastic face rest. Preferably, the present invention comprises an arch shaped webbing formed over a rigid structure. According to a preferred embodiment, the present invention is shaped similar to that of a vortex or torus that can stretch, and form fit to the user's head/face with no pressure points. Furthermore, the present invention may exist as a standalone structure, or a removable attachment to a previously existing structure for attaching to a treatment table.

17 Claims, 10 Drawing Sheets

(56) References Cited

U.S. PATENT DOCUMENTS

| | | | | |
|---|---|---|---|---|
| 5,033,138 | A * | 7/1991 | Hong | A47G 9/1009 5/636 |
| 5,120,110 | A | 6/1992 | Tseng | |
| 5,220,699 | A * | 6/1993 | Farris | A61G 13/12 5/636 |
| 5,337,429 | A * | 8/1994 | Tucker | A45D 19/04 5/636 |
| 5,520,623 | A * | 5/1996 | Williams | A61G 13/12 602/17 |
| 6,694,551 | B1 * | 2/2004 | Garrido | A47C 20/026 5/643 |
| 7,676,867 | B2 * | 3/2010 | De Laura | A61G 13/0054 5/643 |
| 8,769,745 | B1 * | 7/2014 | Lin | A47G 9/1009 5/643 |
| 9,398,992 | B1 * | 7/2016 | Jansen | A47C 20/026 |
| 11,202,522 | B2 * | 12/2021 | Sakamoto | A47C 7/383 |
| 2008/0271248 | A1 * | 11/2008 | DeLaura | A61G 13/0054 5/638 |
| 2010/0325802 | A1 | 12/2010 | Schwartz | |
| 2011/0000022 | A1 * | 1/2011 | Schlanger | A61G 13/12 5/630 |
| 2022/0160572 | A1 * | 5/2022 | Ross | A61H 3/00 |

OTHER PUBLICATIONS

The Stretch Collection, Retrieved from Internet, Apr. 14, 2010 <URL: https://www.contemporist.com/the-stretch-collection-by-carnevale-studio/>.

Herman Miller Aeron Chair Headrest- Manufacturer Direct Engineered Now H4 Engage, Retrieved from Internet, Retrieved on Nov. 19, 2015 <URL: https://www.amazon.com/Engineered-Now-Headrest-Herman-Classic/dp/B00MV8C8TA>.

Master Massage Simplicity Adjustable Massage Table Face Cradle, Retrieved from Internet, Retrieved on Nov. 19, 2015 <URL: https://www.mastermassage.com/products/master-massage-simplicity-massage-table-face-cradle>.

StrongLite Double Action Plus Face Rest Vintage Replacement, Retrieved from Internet, Retrieved on Nov. 19, 2015 <URL: https://www.massageking.com/products/Face-Rest/StrongLite-Double-Action-Plus-Face-Rest-Vintage-Replacement/1288/1/1>.

* cited by examiner

ELASTICALLY WOVEN FACE CRADLE

The current application claims a priority to the U.S. Provisional Patent application Ser. No. 62/823,789 filed on Mar. 26, 2019.

FIELD OF THE INVENTION

The present invention generally relates to a face cradle for a massage therapy table. More specifically, the present invention uses elastic woven components to better conform to the unique contours of each client's face as they rest their head while in the face-down position.

BACKGROUND OF THE INVENTION

Face cradles for a massage therapy table have not always been comfortable for a patient or client, when the patient lies on the massage therapy table with their face resting upon the face cradle. Typically, a face cradle has a rigid C-shaped frame that is uniformly padded with a cotton or synthetic material. This design for a face cradle has an inherent flaw in that the rigid C-shaped frame of the face cradle increases the pressure felt at certain points on the patient's face. Consequently, the uniform padding is not able to form-fit to the patient's face because the C-shaped frame does not allow for much structural flexibility with the face cradle. The anatomy of a person's face is very boney, especially near the sinuses, which are located just under very sparse layers of skin and fascia. As a result, the combination of the non-form-fitting nature of a face cradle and the boney anatomy of a person's face can lead to a lot of discomfort and a lot of readjustment as the patient tries to find a comfortable position to rest their face within the face cradle.

An objective of the present invention is to provide users a face cradle, that is able to form-fit to the unique contours of each patient's face, as the user suspends their face within the elastic woven components of the present invention. Accordingly, the present invention provides an apparatus comprising a rigid structure that holds a webbed elastic face rest. Preferably, the webbing is shaped similar to that of a vortex or semi-toroid that can stretch, and form fit to a person's head/face with no pressure points. Furthermore, the present invention may exist as a standalone structure, or as a removable attachment to a previously existing structure for attaching to a treatment table.

DETAILED DESCRIPTION OF THE INVENTION

All illustrations of the drawings are for the purpose of describing selected versions of the present invention and are not intended to limit the scope of the present invention.

In reference to FIGS. 1-10, the present invention is an elastic face cradle. An objective of the present invention is to provide users a face cradle, that is able to form-fit to the unique contours of each user's face, as the user suspends their face within the elastic woven components of the present invention. Further, it is an aim of the present invention to provide a face cradle that allows the patient to quickly find a comfortable position to rest their face on the face cradle without readjusting themselves too much. Accordingly, the present invention provides an apparatus comprising a structure that holds a webbed elastic face rest. According to a preferred embodiment, the present invention is shaped similar to that of a vortex or torus, that can stretch, and form fit to a person's head/face with no pressure points. Furthermore, the present invention may exist as a standalone structure, or as a removable attachment to a previously existing structure for attaching to a treatment table.

Figure 1:
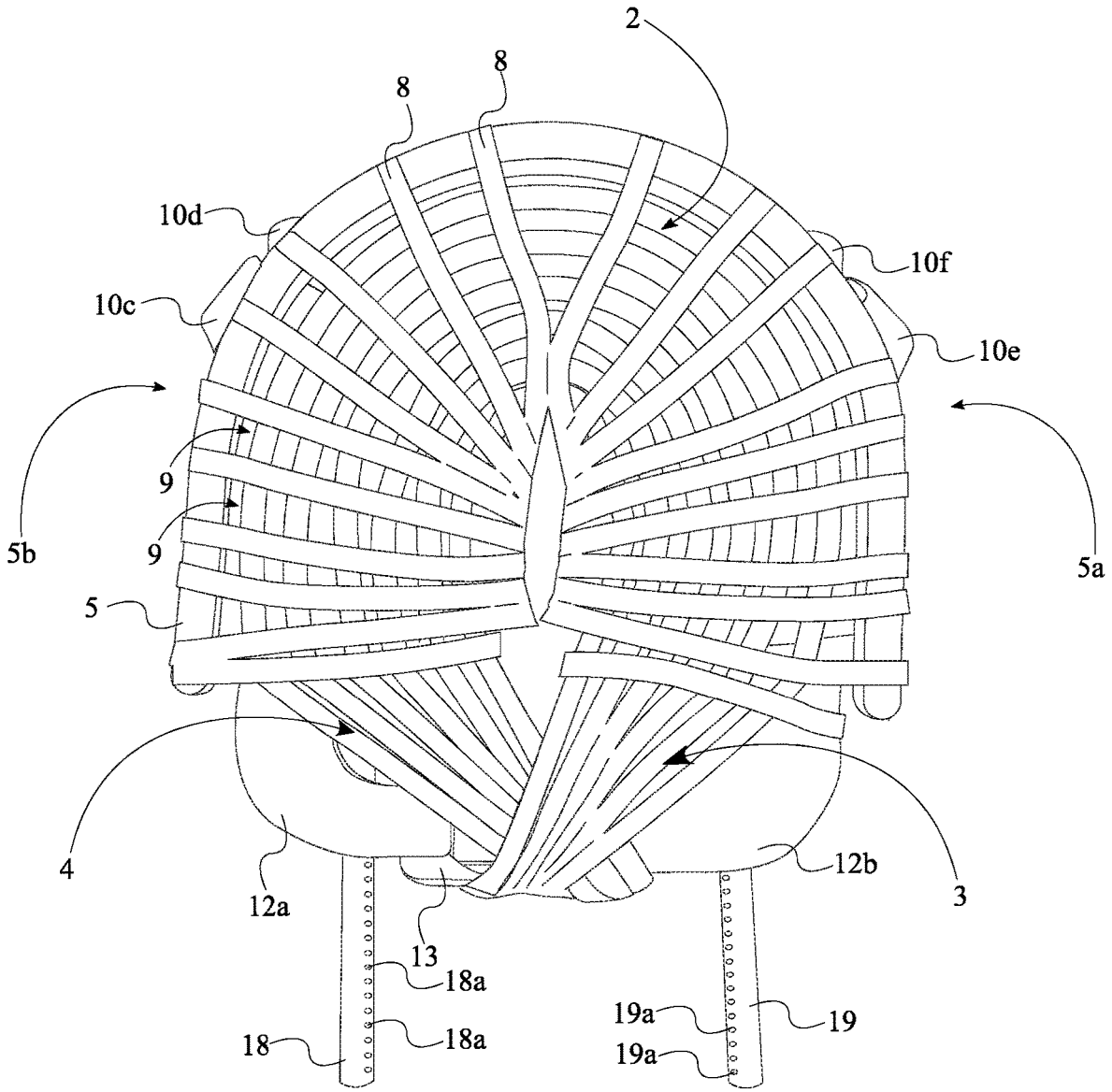
FIG. 1 is a top plane view of a preferred embodiment of the present invention.
Figure 2:
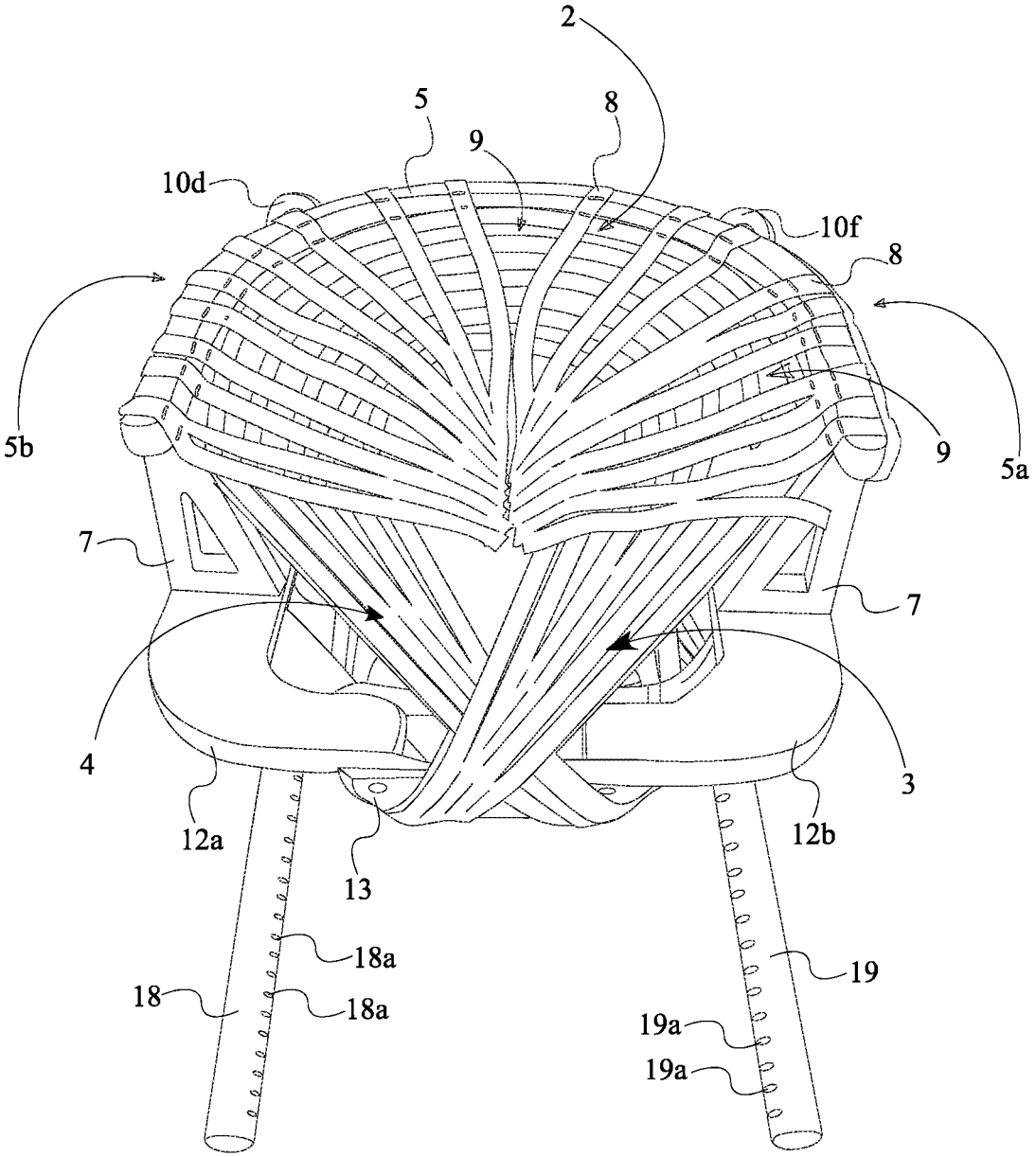
FIG. 2 is a top-front perspective view of the present invention.
Figure 3:
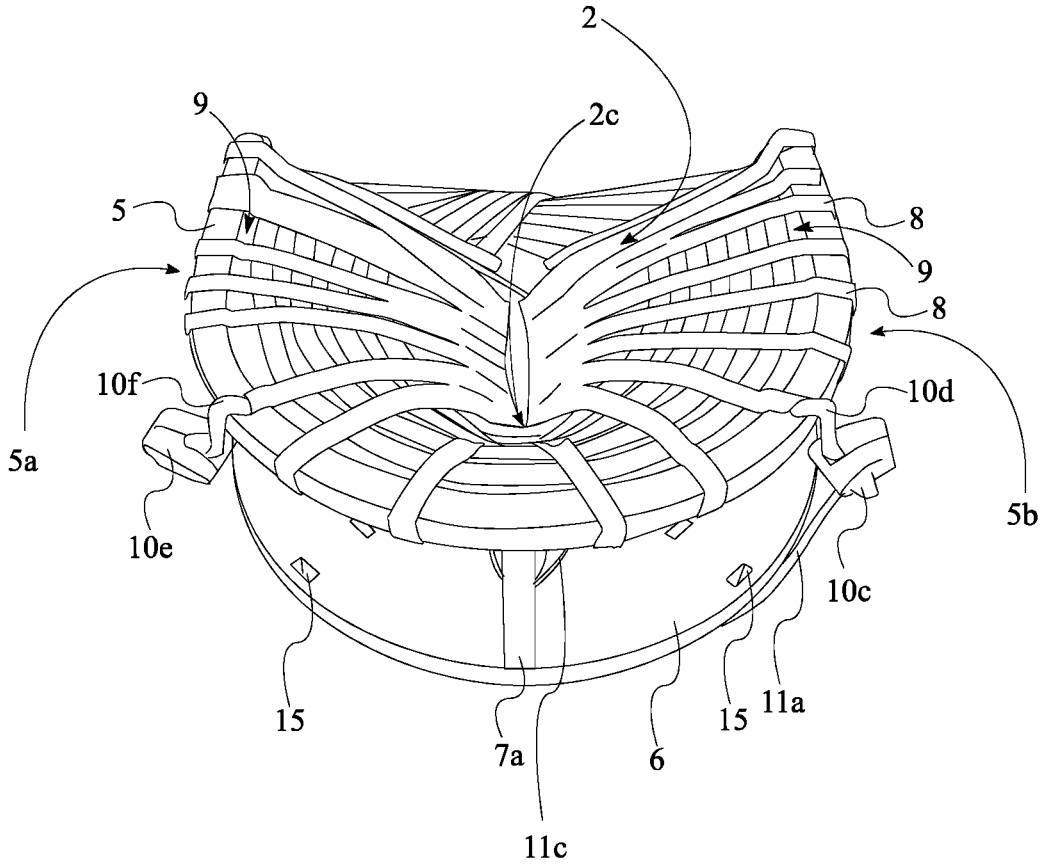
FIG. 3 is a top perspective view from the rear of the present invention.
Figure 4:
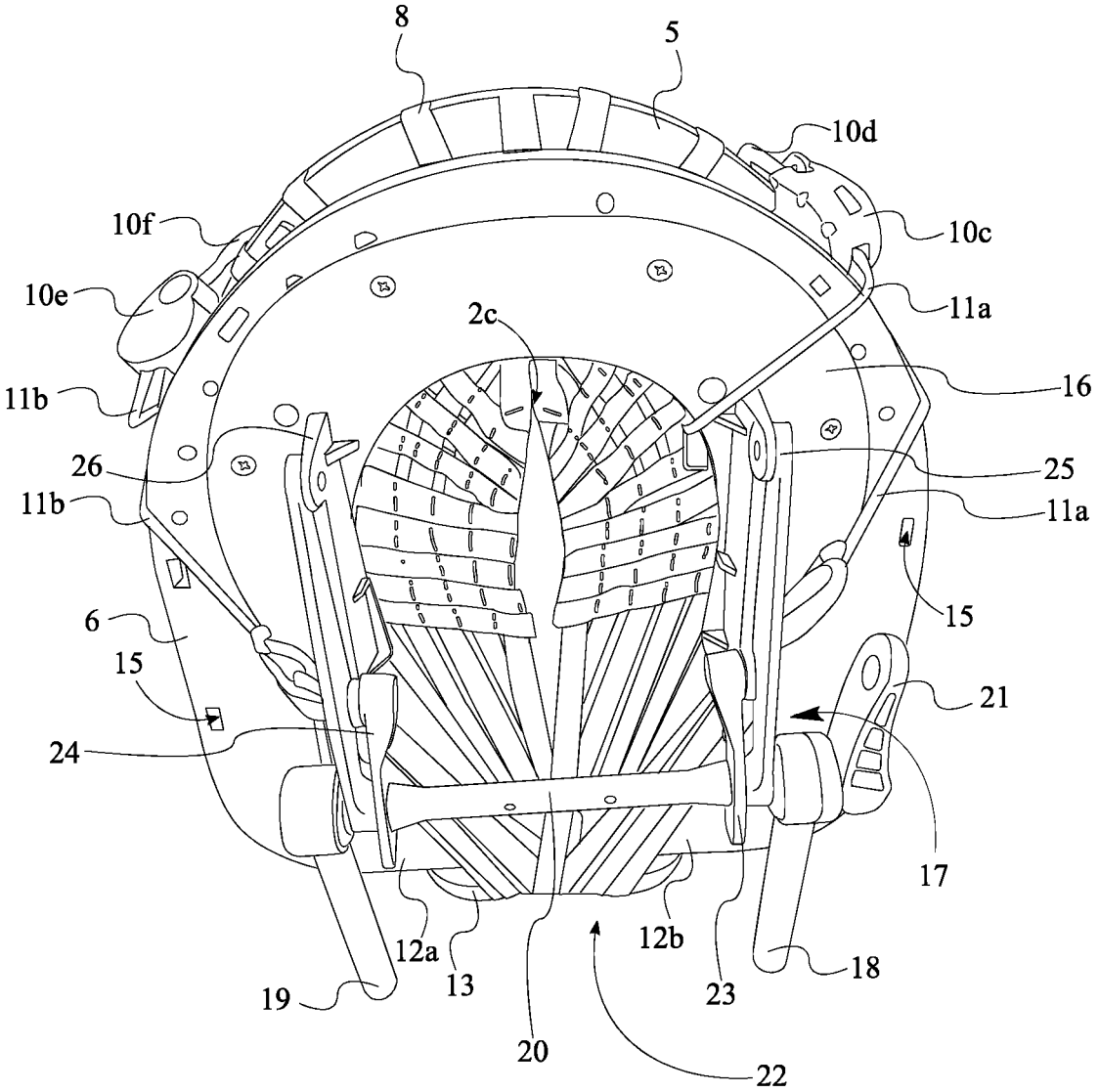
FIG. 4 is a bottom rear perspective view of the present invention, wherein the angle adjustment bar is in an unlocked position.
Figure 5:
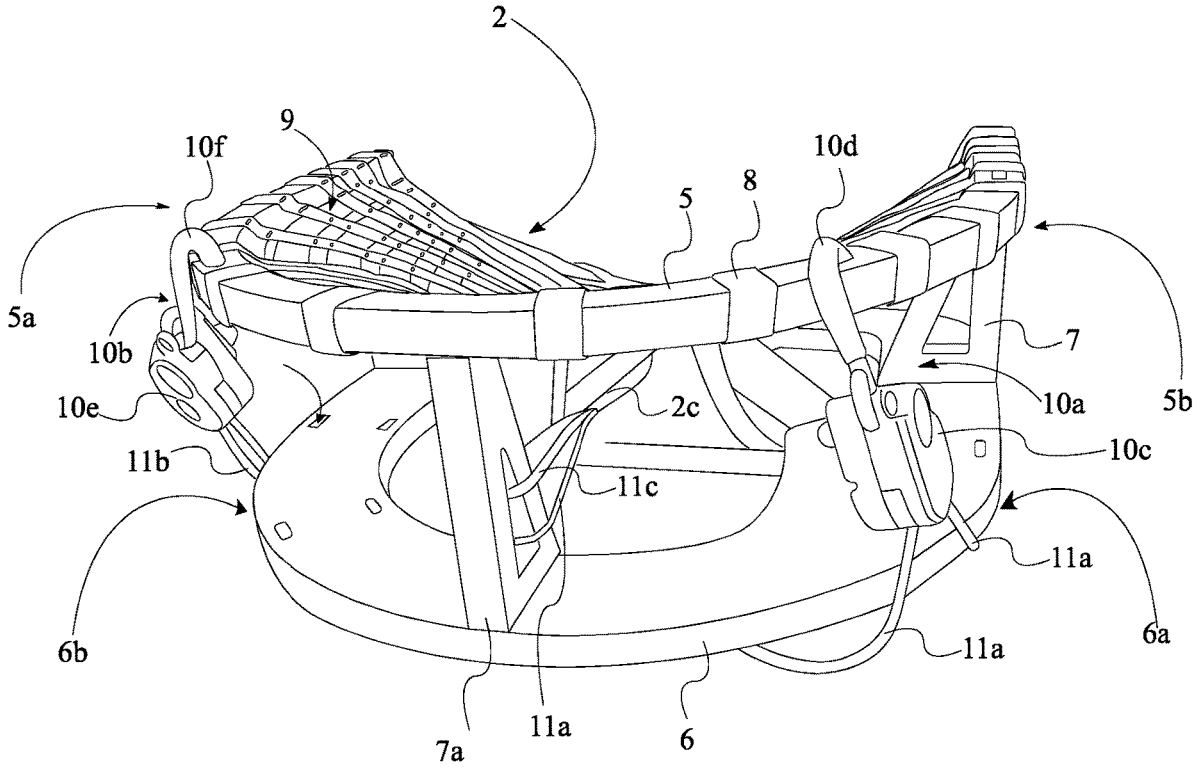
FIG. 5 is a perspective view from the rear of the present invention.
Figure 6:
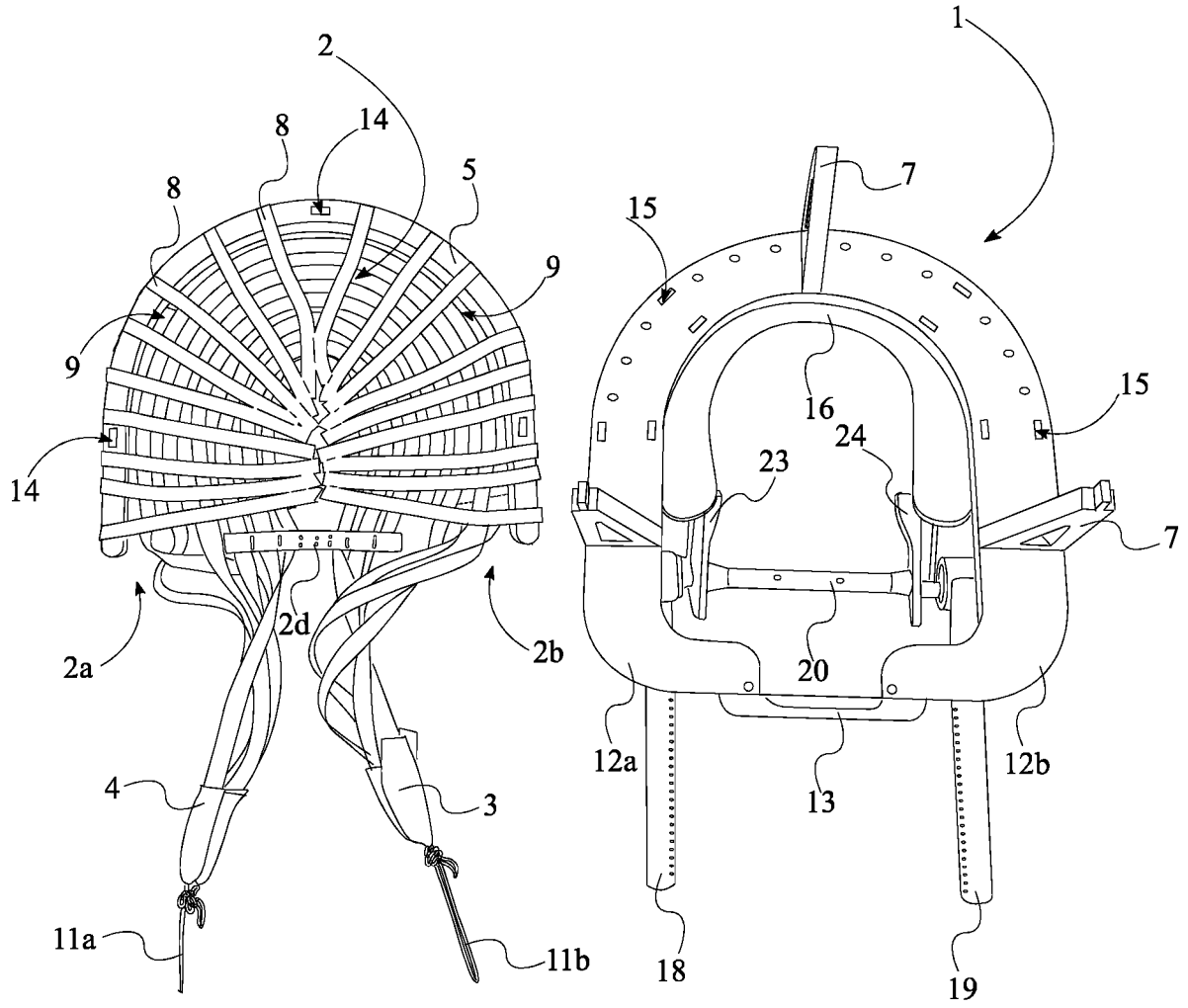
FIG. 6 is a top plane view of the present invention, wherein the arch-shaped webbing together with the first U-shaped frame is placed separately from the rest of the invention.
Figure 7:
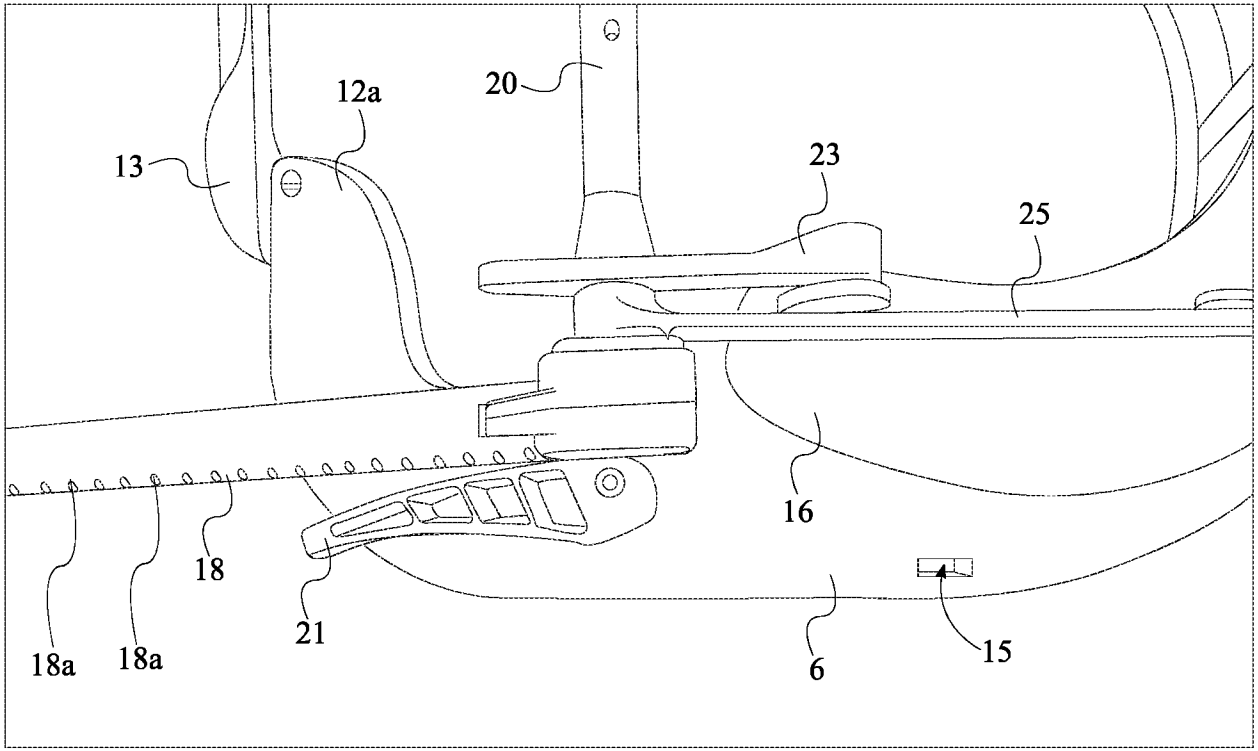
FIG. 7 is a detailed view from the bottom of the present invention, wherein the angle adjustment bar is in a locked position.
Figure 8:
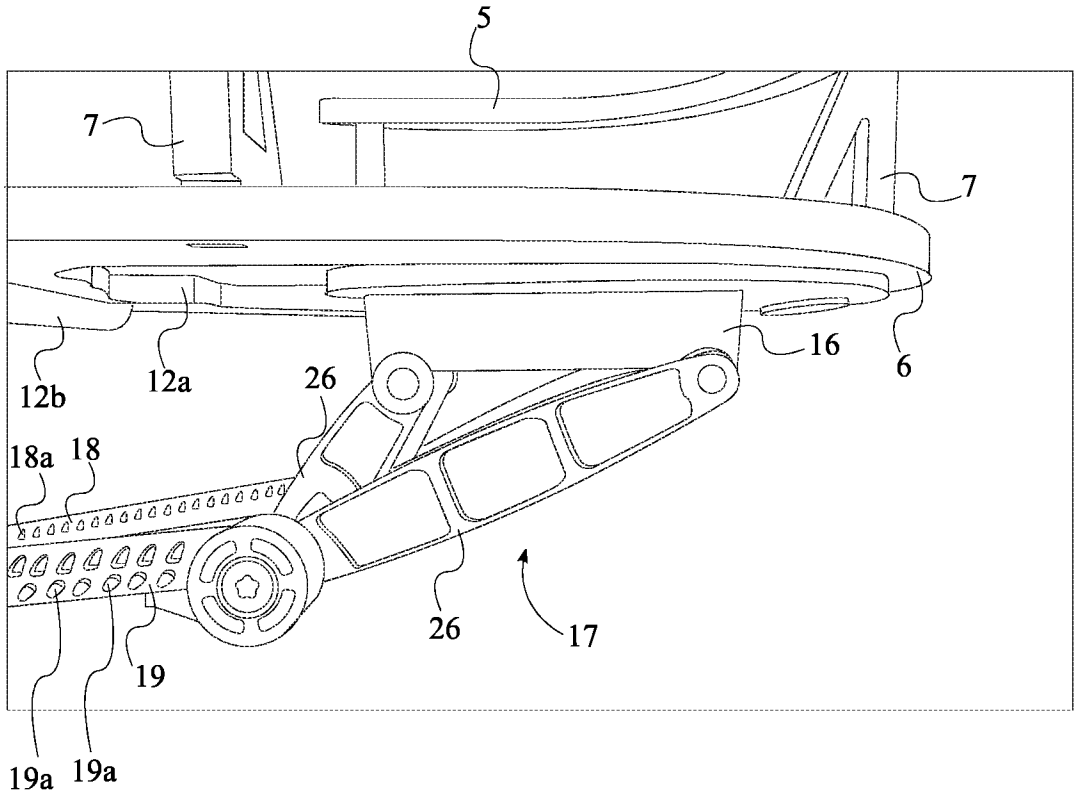
FIG. 8 is a detailed view from the left side of the present invention, wherein the support assembly is in an unfolded position.
Figure 9:
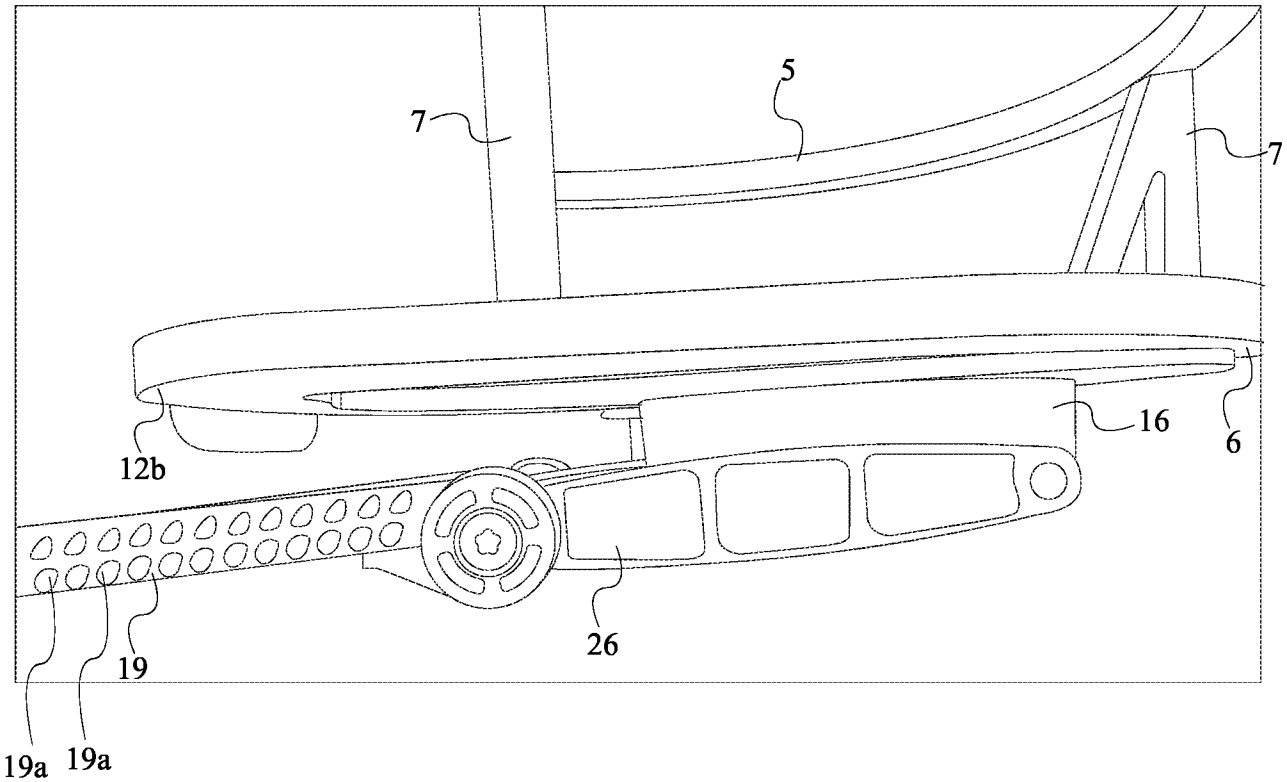
FIG. 9 is a detailed view from the left side of the present invention, wherein the support assembly is in a folded position.

The following description is in reference to FIG. 1 through FIG. 10. According to the preferred embodiment, the elastic face cradle comprises a rigid frame 1, an arch-shaped webbing 2, at least one first adjustment strap 3, and at least one second adjustment strap 4. Preferably, the rigid frame 1 forms the structural frame that is configured to define the overall shape of the arch-shaped webbing 2. As seen in FIG. 1 through FIG. 6, the rigid frame 1 comprises a first U-shaped frame 5, a second U-shaped frame 6, and a plurality of supports 7. Preferably, the first U-shaped frame 5 is linearly offset from, and concentrically aligned to the second U-shaped frame 6, and the plurality of supports 7 is mounted between the first U-shaped frame 5 and the second U-shaped frame 6. The offset between the first U-shaped frame 5 and the second U-shaped frame 6 provides enough spacing for the arch-shaped webbing 2 to flex, as the elastic face cradle receives the weight of a person's head. Preferably, the first U-shaped frame 5, the second U-shaped frame 6 and the plurality of supports 7 are constructed using materials including, but not limited to steel or a durable plastic, carbon fiber etc. However, the rigid frame 1 many comprise any other materials, size, shape, components or arrangement of components that are known to one of ordinary skill in the art, as long as the intended purpose and/or objectives of the present invention is fulfilled. According to the preferred embodiment, the first U-shaped frame 5 and the second U-shaped frame 6 are two identically shaped structures, and the plurality of supports 7 provides structural integrity and spacing between the first U-shaped frame 5 and the second U-shaped frame 6. As seen in FIG. 2, FIG. 5, and FIG. 6, each of the plurality of supports 7 is constructed in a triangular shape, however the plurality of supports 7 may comprise any shape, size, features, components, or arrangement of components, that are known to one of ordinary skill in the art, as long as the intended purpose of the present invention is not hindered. Further, the plurality of supports 7 is distributed between the first U-shaped frame 5 and the second U-shaped frame 6 in such a way that, when the user/patient lies their face/head onto the elastic face cradle, the tension felt by the arch-shaped webbing 2 is evenly dispersed throughout the rigid frame 1. Furthermore, the first U-shaped frame 5 is perimetrically mounted around the arch-shaped webbing 2, such that an intermediary leg of the first U-shaped frame 5 defines the overall curvature of the arch-shaped webbing 2. In other words, the arch-shaped webbing 2 is mounted to, and evenly distributed within the first U-shaped frame 5.

According to the preferred embodiment, the first adjustment strap 3 is tethered in between a first end 2*a* of the arch-shaped webbing 2 and the second U-shaped frame 6. Similarly, the second adjustment strap 4 is tethered in between a second end 2*b* of the arch-shaped webbing 2 and the second U-shaped frame 6. Preferably, the first adjustment strap 3 and the second adjustment strap 4 are continuous or floating elements of the arch shaped webbing 2, that are not interconnected or webbed. Further, the arch-shaped webbing 2 gets the desired shape and dip for placing the user's face, by providing the right amount of pull or tension, on the first adjustment strap 3 and the second adjustment strap 4, of the arch-shaped webbing 2. Accordingly, the arch-shaped webbing 2 converges towards a center of the first U-shaped frame 5 to form a tensioned webbed surface, so that as the patient suspends their face in the tensioned webbed surface, the peripheral areas of their face comfortably rest onto the arch-shaped webbing 2.

In the preferred embodiment, the arch-shaped webbing 2 comprises a plurality of support straps 8 and a plurality of slots 9, wherein the plurality of slots 9 traverses through the arch-shaped webbing 2. In other words, the arch-shaped webbing 2 is made from the plurality of support straps 8 that are interconnected and arranged in a way to simulate a webbed surface having the plurality of slots 9 or gaps traversing through them.

According to the present invention, the plurality of support straps 8 may have different arrangements to better cater the present invention to the unique features of the patient's head. Preferably, each of the plurality of support straps 8 comprises an even thickness. The preferable method of manufacturing the arch-shaped webbing 2 is to position one support strap onto and along another support strap and then attach the two straps at evenly distributed points along the two straps. Consequently, the arch-shaped webbing 2 has a plurality of C-shaped paths, wherein the C-shaped paths that are closer to the center of the arch-shaped webbing have a sharper curvature than the C-shaped paths that are closer to the first U-shaped frame 5. Further, since the arch-shaped webbing 2 is strung across the rigid frame 1, the rigid frame 1 is able to define the overall shape of the arch-shaped webbing 2.

Continuing with the preferred embodiment of the present invention, the arch-shaped webbing 2 has an elastic property so that each of the plurality of support straps 8 can flex to accommodate the unique contours of one patient's face and can reflex to their original position. Furthermore, the plurality of support straps 8 can then flex again to accommodate the unique contours of another patient's face. According to the preferred embodiment, the first adjustment strap 3 and the second adjustment strap 4 are unwebbed extensions of the same plurality of support straps 8 that make up the arch-shaped webbing 2. As seen in FIG. 6, the arch shaped webbing 2 may comprise a horizontal strap 2*d* with a plurality of holes, that connects the first adjustment strap 3 and the second adjustment strap 4 to each other. The duty of the horizontal strap 2*d* is to keep some tension between the two sides, so that when a client rests their face in the cradle, there is still enough support to keep the chin from over expanding the support straps and allowing the head to crane forwards.

It is an aim of the present invention to provide a face cradle that fits to the unique contours of the face of any patient. In order to accomplish that, the present invention comprises at least one first adjustable fastener 10*a*, and at least one second adjustable fastener 10*b*. The first adjustable fastener 10*a* and the second adjustable fastener 10*b* allows the user/patient to adjust the tension on the arch-shaped webbing 2 or the tensioned webbed surface, so as to make the face cradle comfortable for their face or head. Accordingly, the first adjustable fastener 10*a* is connected in between the first adjustment strap 3 and a second leg 5*b* of the first U-shaped frame 5, and the second adjustable fastener 10*b* is connected in between the second adjustment strap 4 and a first leg 5*a* of the first U-shaped frame 5. This arrangement ensures that the first adjustment strap 3 and the second adjustment strap 4 may be accessed by the user from both sides of the first U-shaped frame 5, in order to adjust the tension on the arch-shaped webbing 2. Further, the positioning of the first adjustable fastener 10*a* and the second adjustable fastener 10*b* provides the extra stretch and tension needed to support the whole face region of the user. As seen in FIG. 5, the first adjustable fastener 10*a* may comprise a first adjustment element 10*c*, and a first fastening element 10*d*. Similarly, the second adjustable fastener 10*b* may comprise a second adjustable element 10*e* and a second fastening element 10*f*. Preferably, the first adjustment element 10*c* and the second adjustment element 10*e* are ratchet tension devices that can adjust the pull on the first adjustment strap 3 and the second adjustment strap 4 respectively. Further, according to the preferred embodiment, the first fastening element 10*d* and the second fastening element 10*f* comprise c-hooks. However, the first adjustable fastener 10*a* and the second adjustable fastener 10*b* may comprise one or more of any kind of tension adjusting and fastening mechanism that are known to one of ordinary skill in the art, examples of which include, but are not limited to, a single winding spool/reel to which the first adjustment strap 3 and the second adjustment strap 4 are connected, hook and loop fasteners, snap buttons etc.

In the preferred embodiment, the present invention comprises at least one first drawstring 11*a* and at least one second drawstring 11*b*, wherein the first drawstring 11*a* is terminally attached to the first adjustment strap 3 and the second drawstring 11*b* is terminally attached to the second adjustment strap 4. The positioning of the first drawstring 11*a* and the second drawstring 11*b* ensure easy access and control of first adjustment strap 3 and the second adjustment strap 4 respectively. The first drawstring 11*a* and the second drawstring 11*b* may comprise any material, size and length, as long as they do not hinder the intended purpose of the present invention. Examples of which include, but are not limited to, strings, elastic bands, ropes, or cables. Preferably, the first drawstring 11*a* is threaded through at least one first tensioning support wherein the at least one first tensioning support is from the plurality of supports 7. Similarly, the second drawstring 11*b* is threaded through at least one second tensioning support, wherein the at least one second tensioning support is from the plurality of supports 7. This arrangement enables proper securing of the arch-shaped webbing 2 to the rigid structure 1, as well as even distribution of tension on the arch-shaped webbing 2. In case of having a single tension adjusting mechanism, the first drawstring 11*a* and the second drawstring 11*b* would be threaded through a tensioning support that is positioned midway or along the center of the U, between the first U-shaped frame 5 and the second U-shaped frame 6. However, the first tensioning support and the second tensioning support may comprise any rigid feature along the rigid support 1, as long as the intended purpose of the present invention is fulfilled. Once the user reaches the desired level of tension within the arch-shaped webbing 2, the two ends of each of the first drawstring 11*a* and the second drawstring 11*b* need to be held in place within the rigid frame 1, either through knots, fasteners, or some other tension-holding means. Accordingly, the first drawstring 11*a* is operatively coupled to the first adjustable fastener 10*a*, wherein applying force to the first drawstring 11*a* causes the first adjustable fastener 10*a* to adjust tension in the arch-shaped webbing 2. Thus, the first drawstring 11*a* enables the user to adjust the tension of the arch-shaped webbing 2 from the second leg 5*b* of the first U-shaped frame 5. Similarly, the second drawstring 11*b* is operatively coupled to the second adjustable fastener 10*b*, wherein applying force to the second drawstring 11*b* causes the second adjustable fastener 10*b* to adjust tension in the arch-shaped webbing 2. Thus, the second drawstring 11*b* provides easy access for the user to adjust the tension of the arch-shaped webbing 2 from the first leg 5*a* of the first adjustable fastener 5. According to the preferred embodiment, at least one third drawstring is terminally attached to an apex region 2*c* of the arch-shaped webbing. Preferably, the third drawstring 11*c* is threaded through at least one third tensioning support, wherein the at least one third tensioning support is from the plurality of supports 7. In other words, the third drawstring 11*c* comprises one or more independent straps that are tethered to the rigid frame 1, as well as the apex region 2*c* of the arch-shaped webbing 2. This is so that the webbing along the sharpest curvature region is separated and the pull reduces the tension on the forehead region of the user. As seen in FIG. 5, the third tensioning support 7*a* is positioned midway between the first U-shaped framed 5 and the second U-shaped frame 6. It is an aim of the present invention to offer support to the user's head or face using a webbed and/or weaved system that is attached to a rigid support structure. In order to accomplish that, the present invention further comprises a first corner ledge 12*a*, a second corner ledge 12*b*, and a connecting bracket 13. Preferably, the first corner ledge 12*a* is terminally connected to a first leg 6*a* of the second U-shaped frame 6 and the second corner ledge 12*b* is terminally connected to a second leg 6*b* of the second U-shaped frame 6, such that the first corner ledge 12*a* and the second corner ledge 12*b* provide structural support for holding the first adjustment strap 3 and the second adjustment strap 4, and thus the lower half of the user's face. Further, the first corner ledge 12*a* extends toward the second corner ledge 12*b* and the connecting bracket 13 is connected in between the first corner ledge 12*a* and the second corner ledge 12*b*, such that the first adjustment strap 3 and the second adjustment strap 4 are laid over the connecting bracket 13. Thus, the connecting bracket 13 provides a guiding path for creating the vortex shape of the tensioned webbed surface.

Continuing with the preferred embodiment, the present invention further comprises a first plurality of mounting holes 14 and a second plurality of mounting holes 15. The first plurality of mounting holes 14 and the second plurality of mounting holes 15 may comprise, any size, shape and orientation, as long as the intended purpose of the present invention is not altered. Preferably, the first plurality of mounting holes 14 traverses into the first U-shaped frame 5, and the second plurality of mounting holes 15 traverses into the second U-shaped frame 6, such that they act as attachment points for the plurality of supports 7. Accordingly, each of the plurality of supports 7 is engaged into at least one corresponding first mounting hole from the plurality of first mounting holes 14, and each of the plurality of supports 7 is engaged into at least one corresponding second mounting hole from the plurality of second mounting holes 15.

According to the preferred embodiment, the present invention is a retrofit device for the massage therapy table, wherein the elastic face cradle may be manually attached to the massage therapy table. In order to accomplish that, the present invention further comprises a support platform 16, a support assembly 17, a first rod 18, a second rod 19, and a crossbar 20. Preferably, the support platform 16 is connected adjacent to the second U-shaped frame 6, opposite to the plurality of supports 7. This is because, the patient's face must travel through the first U-shaped frame 5 before resting upon the arch-shaped webbing 2, and hence all mechanical support and mounting elements are placed on the lower surface of the second U-shaped frame 6. Preferably, the support platform 16 is screwed to the second U-shaped frame 6. However, any other fastening mechanism that is known to one of ordinary skill in the art may be employed for fastening the support platform 16 to the rigid frame 1. As seen in FIG. 4, the support platform 16 is a U-shaped base that allows all of the other components of the present invention to be connected together. However, the support platform 16 may comprise any other shape and/or material that are known to one of ordinary skill in that art, as long as the intended purpose of the present invention is not altered. Further, the support assembly 17 is mounted in between the support platform 16, the first rod 18, and the second rod 19, such that the support assembly 17 controls the mechanical operations between the support platform 16, the first rod 18 and the second rod 19. Preferably, the first rod 18 and the second rod 19 are used to mount the present invention to the front end of a massage therapy table. As seen in FIG. 1, FIG. 2, FIG. 4 and FIG. 6, the first rod 18 is positioned offset from the second rod 19, across the support assembly 17, and the crossbar 20 is connected in between the first rod 18 and the second rod 19. Further, it is preferred that the length of the upper portion of the elastic face cradle (comprising the first U-shaped frame 5, the second U-shaped frame 6 and the tensioned webbed surface), is shorter than the lower portion of the face cradle (comprising the first rod 18 and the second rod 19). This is to allow room for the client's shoulders and to allow room for the therapist to work on the client's shoulder/neck area with his or her elbows or hands.

It is an aim of the present invention to allow users to adjust the position of the elastic face cradle in multiple directions. Those directions include, but are not limited to, an up and down adjustment and/or a forward/rearward adjustment. In order to accomplish that, the present invention further comprises at least one angle-adjustment bar 21, wherein the user may maneuver the angle adjustment bar 21 to actuate and stop positional displacements. Further, the support assembly 17 comprises at least one adjustable support linkage 22, and the adjustable support linkage 22 comprises a first linkage rod 23, a second linkage rod 24, a first linkage mount 25, and a second linkage mount 26. Preferably, the first linkage mount 25 is rotatably connected in between the support platform 16 and the first linkage rod 23, such that angular displacement between the first linkage mount 25 and the first linkage rod 23 enables the support frame 16 to move forward, rearward, upward, downward etc. Further, the crossbar 20 is rotatably connected to the first linkage rod 23, wherein the crossbar 20 is positioned offset from the first linkage mount 25 across the first linkage rod 23. This arrangement with the crossbar 20 ensures a stable connection of the support frame 16 with the massage table. Similar to the above described arrangement, the second linkage mount 26 is rotatably connected in between the support platform 16 and the second linkage rod 24. Further, the second linkage mount 26 is positioned offset from the first linkage mount 25, across the support platform 16. Furthermore, the crossbar 20 is rotatably connected to the second linkage rod 24, and the crossbar 20 is positioned offset from the second linkage mount 26 across the second linkage rod 24. The above arrangements ensure mechanical and operational stability to the various components of the adjustable support linkage 22, and the crossbar 20. Furthermore, the one angle adjustment bar 21 is operatively coupled to the crossbar 20, wherein rotating the angle adjustment bar 21 between a locked position and an unlocked position enables the adjustable support linkage 22 to modify a distance between the support platform 16, the first rod 18, and the second rod 19. In other words, the various components, relations, and arrangement of the components of the adjustable support linkage 22 and the angle adjustment bar 21, enables smooth positional displacement of the elastic face cradle with respect to the massage table.

As seen in FIG. 1, FIG. 2 and FIG. 7 through FIG. 9, the first rod 18 comprises a first plurality of ribs 18*a*, wherein the first plurality of ribs 18*a* is serially distributed along the first rod 18. Similarly, the second rod 19 comprises a second plurality of ribs 19*a*, wherein the second plurality of ribs 19*a* is serially distributed along the second rod 19. The first plurality of ribs 18*a* and the second plurality of ribs 19*a* are parts of a mounting mechanism that enables to manually attach the present invention to the massage/therapy table. However, the first rod 18 and the second rod 19 may comprise any mounting mechanism that is known to one of ordinary skill in the art, as long as the user is allowed to selectively attach or detach the present invention from the massage therapy table.

Figure 10:
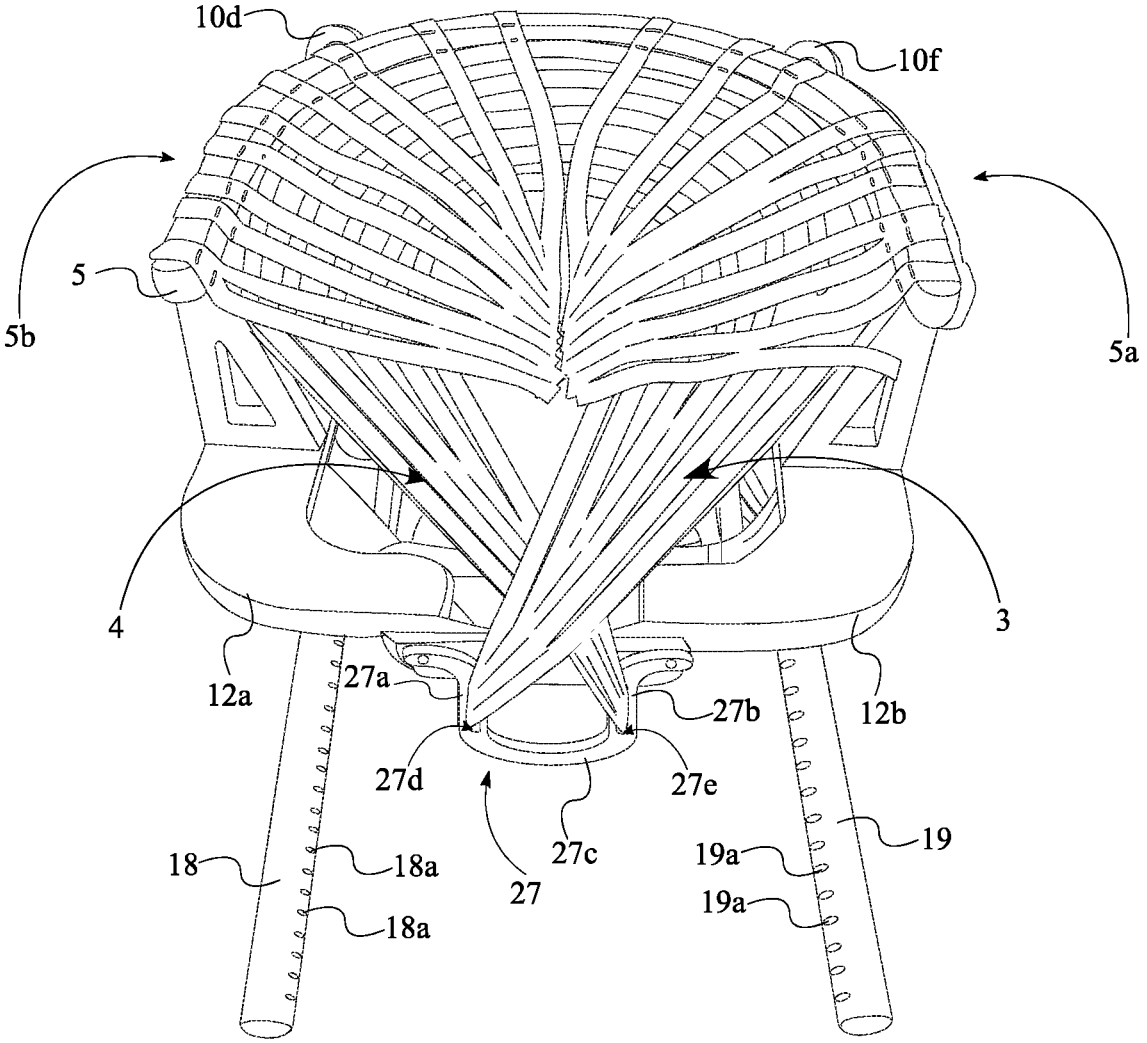
FIG. 10 is a top front perspective view of an alternated embodiment of the present invention, wherein a tension directing device is integrated into the present invention.

In a first alternate embodiment, the present invention comprises a tension directing device 27, which may be used as a junction to redirect the tension applied to the arch-shaped webbing 2. Preferably, at least one tension directing slot (27*d* and 27*e*) traverses through the tension directing device 27, and the tension directing device 27 is positioned in between terminal ends of the second U-shaped frame 6. Further, the at least one tension directing slot (27*e* and 27*e*) traverses through the tension directing device. Furthermore, the first adjustment strap 3 and the second adjustment strap 4 are threaded through the at least one tension directing slot (27*d* and 27*e*). This is so that applying force to the tension directing device 27 adjusts the tension in the arch-shaped webbing 2. As seen in FIG. 10, the tension directing device 27 comprises a horseshoe shape, and the at least one tension directing slots (27*c* and 27*d*) are positioned symmetrically along two legs of the horseshoe shaped tension directing device. According to this alternate embodiment, the horseshoe comprises a flared left leg 27*a*, a flared right leg 27*b*, a curved bridge 27*c*, a first slot 27*d*, and a second slot 27*e*. The flared left leg 27*a* and the flared right leg 27*b* are connected to their respective ends of the curved bridge 27*c* in order to form the overall shape of the horseshoe. As seen in FIG. 10, the first adjustment strap 3 and the second adjustment strap 4 are strung through the second slot 27*d* and the first slot 27*e* respectively, before they are directed to the tensioning supports. Preferably the tension directing device is held on to the rigid frame 1 in a solid fashion, with the help of fasteners such as screws and nuts. However, the tension direction device 27 may be tethered to the rigid frame 1 by a plurality of elastic suspension cords. In some embodiments, the tension direction device 27, and the at least one tension directing slots (27*d* and 27*e*) may comprise any shape, size or orientation, and this difference in shape would alter how the plurality of support straps 8 are configured. Further, the plurality of straps 8 that constitute the first adjustment strap 3 and the plurality of straps 8 that constitute the second adjustment strap 4, each may converge to form two single straps, so that they may easily pass through the at least one tension directing slots (27*d* and 27*e*). Preferably, the two single straps constituting the first adjustment strap 3 and the second adjustment strap 4 comprise a thicker elastic strap (thicker when compared to each of the plurality of support straps 8). However, the two single straps may comprise any custom-made material or shape after they pass through the at least one tension directing slots (27*d* and 27*e*), as long as the invented objectives of the present invention is not compromised.

According to the present invention, the arch-shaped webbing 2 may comprise multiple arrangements of the plurality of straps 8. In a second alternate embodiment, the plurality of slots 9 for the arch-shaped webbing 2 allows a plurality of drawstrings to be interwoven into the arch-shaped webbing 2, such that the arch-shaped webbing 2 is connected in between the Intermediary leg of the first U-shaped frame 5 and the Intermediary leg of the second U-shaped frame 6. This embodiment may further comprise a tension directing device 27 of any shape and operate as described in the first alternate embodiment.

In a third alternative embodiment, a method of manufacturing the arch-shaped webbing 2 comprises the following steps. Attach an end of a double-length strap to the second U-shaped frame 6, then wrap the double-length strap about the first U-shaped frame 5, and finally attach the other end of the double-length strap to the second U-shaped frame 5. Another similar method of manufacturing a webbed surface, is to attach an end of a double-length strap to the first U-shaped frame 5, then wrap the double-length strap about the second U-shaped frame 6, and finally attach the other end of the double-length strap to the first U-shaped frame 5. For both alternative methods, the plurality of slots 9 is created along the double-length strap by attaching the two folded portions at evenly distributed points along the folded-over, double-length strap.

A fourth alternative method of manufacturing each of the plurality of support straps 8 with the plurality of slots 9, is to respectively attach the opposing ends of a single support strap to the first U-shaped frame 5 and the second U-shaped frame 6, and to attach a plastic guide along the single strap, wherein the plastic guide is used as the plurality of slots 9. This method of manufacturing costs less than using two straps, and, as an added benefit, the plastic guide allows the plurality of drawstrings to experience less friction while the webbing is being tensioned. Moreover, each of the plurality of drawstrings is positioned through a designated path from the plurality of C-shaped paths. Thus, the user can pull or release the two ends for each of the plurality of drawstrings in order to increase or decrease the tension within the arch-shaped webbing 2.

A fifth alternate embodiment of the present invention comprises an arrangement, wherein the plurality of support straps 8 do not intersect with each other. This arrangement occurs when the first end for each of the plurality of support straps is fixed to a radial position about the Intermediary leg of the first U-shaped frame 5 and when the second end for each of the plurality of support straps is fixed to the same radial position about the Intermediary leg of the second U-shaped frame 6. This arrangement allows each of the plurality of support straps 8 to remain coincident across one vertical plane.

A sixth alternate embodiment of the present invention may be a case where the plurality of support straps 8 do intersect with each other. This arrangement occurs when the first end for each of the plurality of support straps 8 is fixed to a radial position about the Intermediary leg of the first U-shaped frame 5 and when the second end for each of the plurality of support straps is fixed to an offset radial position about the Intermediary leg of the second U-shaped frame 6. This arrangement allows each of the plurality of support straps 8 to have either a clockwise slant or a counterclockwise slant, which depends on the angular direction for the offset radial position of the second end. The set of support straps 8 with the forward slant is interwoven with the set of support straps with the backward slant in order to create a more complex arch-shaped webbing, but which is able to support more weight. Consequently, the plurality of drawstrings needs to be more intricately woven through the arch-shaped webbing than the aforementioned method with the plurality of C-shaped paths.

In a seventh alternate embodiment of the present invention, the first rod 18 and the second rod 19 are built-in components of a massage therapy table, wherein the first rod 18 and the second rod 19 are already fixed to the massage therapy table.

An eighth alternate embodiment of the present invention could optionally include any of the following ancillary features to improve the functionality of the present invention. One optional ancillary feature is to integrate guides for each of the plurality of support straps 8 into the first U-shaped frame 5 and/or the second U-shaped frame 6, so that the present invention is able to maintain the even distribution of the plurality of support straps 8 about the arch-shaped webbing 2. These guides could be, but are not limited to, grooves embedded into the first U-shaped frame 5 and/or the second U-shaped frame 6 or protruding brackets. Another optional ancillary feature is to integrate another tensioning mechanism between the rigid frame 1 and the plurality of support straps 8 so that the plurality of support straps 8 can be separately tensioned from one or more of the plurality of drawstrings. The aforementioned guides could be used to direct how the tensioning mechanism tightens or loosens the plurality of support straps 8.

As a ninth alternate embodiment, the present invention comprises a basic frame (comprising two identical c-shaped frames that are vertically offset from one another) which will house the structure of the torus shaped elastic webbing. In this embodiment, the torus shape of the elastic webbing is achieved by a combination of vertical strips of elastic attached at points along the top rim of the c-shaped frame structure, rounding in and down and around in a c-shape and attaching at corresponding points on the bottom plane c-shape frame structure, said vertical strips having slots formed by sewing two strips of elastic together, or another method such as guides, which are used to house and offer a path. A method of tensioning said strips into the toroidal/vortex shape comprises having strips of elastic running horizontally, or perpendicular to the vertical strips, through said slots and attaching to a tensioned yet flexible and removable structure spanning the distance of the ends of the c-shaped structure of the frame. The tensioning of these horizontal plane elastic strips and having them attached to said flexible spanning elastic structure at calculated points will give the invention its toroidal form and structure. Part of the design of this removable structure for attachment of the horizontal strips will include the ability to easily change the tension of the strips for variations in the weight or shape of a client's head via some mechanism, either by simple hook and loop fasteners or a more complex ratcheting tensioner. The particular design of the webbing can have a few different manifestations and possibilities for different productions. Using this webbed system of elastic should form fit to every angle, structural shape and form of someone's face and head and have more of an inward pressure/supported wedging principal involved than the typical face rest where direct frontal pressure is exerted of the persons face. Further, there is also the possibility of using a non-elastic quality material for one or both of the horizontal and/or vertical strap bodies instead of elastic. The ability of this material to exhibit similar characteristics to elastic would be achieved by attaching small springs to the attachment points of the material to the frame and/or the tensioning mechanism. Also using one big spring-loaded mechanism that all straps would be attached to instead of individual springs. This may offer cost savings, durability and longevity of materials or manufacturability advantages over elastic. Furthermore, in this embodiment, there is a possibility of needing a small yet rigid u-shaped ring with eyelets that the horizontal straps would go through to offer a small amount of additional customizability to the tension of the face rest.

A tenth alternate embodiment comprises the possibility of not needing a second U-shaped frame 6 at all. The first U-shaped frame 5 housing the elastic webbing may be able to be attached directly to the support mechanism (support platform in the preferred embodiment) that offers the adjustment and attaches it to the table. The guide slot for tensioning the plurality of support straps 8 could also be attached to this mechanism. However, this arrangement would modify the shape of the vortex/torus webbing beyond what is created naturally by evenly tensioning the horizontal straps to allow more room for the eyes, eyebrows, cheeks, etc. by adding additional tension to key vertical straps.

In an eleventh alternate embodiment, no tensioning mechanism is necessary for the optimal operation of the invention. This would be possible by using elastic that has a much lower stretch capacity than typical clothing-oriented elastic.

In a twelfth alternate embodiment, a thin pad, most likely memory foam may be included in the design, located on top of the woven elastic structure. The whole idea of zero pressure points through the use of the woven elastic structure is still entirely valid, but the tensioned elastic itself is possibly a bit rigid to be touching the face directly. This pad may additionally be cast or molded to the specific contours of the average person's face with support or inclusions for certain areas, including but not limited to more support for the chin and inclusions for the eye and sinus areas.

In a thirteenth alternate embodiment of the present invention, the arch-shaped webbing 2 is shaped to provide an even surface for the patient to lie their face. In order to accomplish that, the width of the arch-shaped webbing 2 decreases as it traverses from the first U-shaped frame 5 towards the center of the second U-shaped frame 6. Because the arch-shaped webbing 2 varies its width, crowding of the plurality of support straps 8 is ultimately reduced, which allows more support straps to be used if desired.

Although the invention has been explained in relation to its preferred embodiment, it is to be understood that many other possible modifications and variations can be made without departing from the spirit and scope of the invention as hereinafter claimed.

What is claimed is:

1. An elastic face cradle comprising:

a rigid frame;

an arch-shaped webbing;

at least one first adjustment strap;

at least one second adjustment strap;

the rigid frame comprising a first U-shaped frame, a second U-shaped frame, and a plurality of supports;

the first U-shaped frame being linearly offset from, and concentrically aligned to the second U-shaped frame;

the plurality of supports being mounted between the first U-shaped frame and the second U-shaped frame;

the first U-shaped frame being perimetrically mounted around the arch-shaped webbing;

the first adjustment strap being tethered in between a first end of the arch-shaped webbing and the second U-shaped frame;

the second adjustment strap being tethered in between a second end of the arch-shaped webbing and the second U-shaped frame;

at least one first adjustable fastener;

at least one second adjustable fastener;

the first adjustable fastener being connected in between the first adjustment strap and a second leg of the first U-shaped frame; and the second adjustable fastener being connected in between the second adjustment strap and a first leg of the first U-shaped frame.

2. The elastic face cradle of claim 1, wherein the arch-shaped webbing converges towards a center of the first U-shaped frame, thereby forming a tensioned webbed surface.

3. The elastic face cradle of claim 1, wherein the arch-shaped webbing being mounted to, and evenly distributed within the first U-shaped frame.

4. The elastic face cradle of claim 1, wherein the arch-shaped webbing comprises a plurality of support straps and a plurality of slots, wherein the plurality of slots traverses through the arch-shaped webbing.

5. The elastic face cradle of claim 1, wherein the arch-shaped webbing comprises a vortex or semi-toroidal shape.

6. The elastic face cradle of claim 1, comprising:

at least one first drawstring;

the first drawstring being terminally attached to the first adjustment strap;

the first drawstring being threaded through at least one first tensioning support, wherein the at least one first tensioning support is from the plurality of supports; and the first drawstring being operatively coupled to the first adjustable fastener, wherein applying force to the first drawstring causes the first adjustable fastener to adjust tension in the arch-shaped webbing.

7. The elastic face cradle of claim 6, comprising:

at least one second drawstring;

the second drawstring being terminally attached to the second adjustment strap;

the second drawstring being threaded through at least one second tensioning support, wherein the at least one second tensioning support is from the plurality of supports; and the second drawstring being operatively coupled to the second adjustable fastener, wherein applying force to the second drawstring causes the second adjustable fastener to adjust tension in the arch-shaped webbing.

8. The elastic face cradle of claim 7, comprising:

at least one third drawstring, the at least one third drawstring being terminally attached to an apex region of the arch-shaped webbing; and the at least one third drawstring being threaded through at least one third tensioning support, wherein the at least one third tensioning support is from the plurality of supports.

9. The elastic face cradle of claim 1, comprising:

a first corner ledge;

a second corner ledge;

a connecting bracket;

the first corner ledge being terminally connected to a first leg of the second U-shaped frame;

the second corner ledge being terminally connected to a second leg of the U-shaped frame;

the first corner ledge extending toward the second corner ledge;

the connecting bracket being connected in between the first corner ledge and the second corner ledge; and the first adjustment strap and the second adjustment strap being laid over the connecting bracket.

10. The elastic face cradle of claim 1, comprising:

a first plurality of mounting holes;

a second plurality of mounting holes;

the first plurality of mounting holes traversing into the first U-shaped frame;

the second plurality of mounting holes traversing into the second U-shaped frame;

each of the plurality of supports being engaged into at least one corresponding first mounting hole from the plurality of first mounting holes; and each of the plurality of supports being engaged into at least one corresponding second mounting hole from the plurality of second mounting holes.

11. The elastic face cradle of claim 1 comprising:

a support platform;

a support assembly;

a first rod;

a second rod;

a crossbar;

the support platform being connected adjacent to the second U-shaped frame, opposite to the plurality of supports;

the support assembly being mounted in between the support platform, the first rod, and the second rod;

the first rod being positioned offset from the second rod, across the support assembly; and the crossbar being connected in between the first rod and the second rod.

12. The elastic face cradle of claim 11 comprising:

at least one angle-adjustment bar;

the support assembly comprising at least one adjustable support linkage;

the adjustable support comprising a first linkage rod, a second linkage rod, a first linkage mount, and a second linkage mount;

the first linkage mount being rotatably connected in between the support platform and the first linkage rod;

the crossbar being rotatably connected to the first linkage rod;

the crossbar being positioned offset from the first linkage mount across the first linkage rod;

the second linkage mount being rotatably connected in between the support platform and the second linkage rod;

the second linkage mount being positioned offset from the first linkage mount, across the support platform;

the crossbar being rotatably connected to the second linkage rod;

the crossbar being positioned offset from the second linkage mount across the second linkage rod; and the one angle adjustment bar being operatively coupled to the crossbar, wherein rotating the angle adjustment bar between a locked position and an unlocked position enables the adjustable support linkage to modify a distance between the support platform, the first rod, and the second rod.

13. The elastic face cradle of claim 11, comprising:

a first plurality of ribs; and the first plurality of ribs being serially distributed along the first rod.

14. The elastic face cradle of claim 11, comprising:

a second plurality of ribs; and the second plurality of ribs being serially distributed along the second rod.

15. The elastic face cradle of claim 1, wherein each of the plurality of supports is triangular in shape.

16. The elastic face cradle of claim 1, comprising:

a tension directing device;

at least one tension directing slot;

the tension directing device being positioned in between terminal ends of the second U-shaped frame; and the at least one tension directing slot traversing through the tension directing device;

the first adjustment strap and the second adjustment strap being threaded through the at least one tension directing slot, wherein applying force to the tension directing device adjusts the tension in the arch-shaped webbing.

17. The elastic face cradle of claim 16, wherein the tension directing device comprises a horseshoe shape, and the at least one tension directing slot are positioned symmetrically along two legs of the horseshoe shaped tension directing device.

* * * * *